US005398926A

United States Patent [19]

Skinner

[11] Patent Number: 5,398,926

[45] Date of Patent: Mar. 21, 1995

[54] GAME ACCELERATING TABLE TENNIS TABLE TOP

[76] Inventor: Andrew J. Skinner, 57 Woodlawn Dr., Williamstown, Mass. 01267

[21] Appl. No.: 192,841

[22] Filed: Feb. 7, 1994

[51] Int. Cl.[6] ..... A63B 39/00

[52] U.S. Cl. ..... 273/30

[58] Field of Search ..... 273/30, 29 R; 472/92

[56] References Cited

U.S. PATENT DOCUMENTS

| | | | |
|---|---|---|---|
| 2,066,159 | 7/1936 | Post . | |
| 2,111,339 | 2/1938 | Squires . | |
| 3,203,696 | 8/1965 | Sawyer | 273/29 R |
| 3,968,967 | 9/1976 | Nally . | |
| 3,992,006 | 5/1976 | Barlow . | |
| 4,142,718 | 3/1979 | Luckey | 273/30 |
| 4,146,225 | 1/1979 | Hallet . | |
| 4,650,180 | 3/1989 | Blondel | 472/92 |

FOREIGN PATENT DOCUMENTS

| | | |
|---|---|---|
| 2606653 | 11/1988 | France . |
| 25767 | of 1901 | United Kingdom . |
| 473665 | 2/1937 | United Kingdom . |
| 1556699 | 8/1990 | U.S.S.R. . |

*Primary Examiner*—Theatrice Brown

[57] ABSTRACT

A table top to be used in games of table tennis and the like. The table top is convex in one or more directions. The convexity provides a deflection bias to a ball in play so that the post-bounce trajectory has more horizontal velocity and less vertical velocity than would be present had it bounced off of a flat or concave surface. This deflection bias increases near the edges of the table. As a general rule, the more challenging a ball's pre-bounce trajectory is, the closer it bounces to the edge of the table, because it is already travelling low and fast. Thus, the more challenging a ball's trajectory is, the more deflection bias is provided, resulting in an even more challenging trajectory. This serves to accelerate the game, always making it more and more challenging, and adds elements of sportsmanship, competition, and strategy.

2 Claims, 3 Drawing Sheets

GAME ACCELERATING TABLE TENNIS TABLE TOP

BACKGROUND—FIELD OF INVENTION

This invention relates to table tops used to play various versions of the game of table tennis.

BACKGROUND—DESCRIPTION OF PRIOR ART

There exist table tops upon which to play the game of table tennis or the like. These tables are generally rectangular and flat and have field lines which indicate different regions of the playing surface. A net usually stretches above the table along the short axis, equidistant from each end. Players stand at each end and bat a ball back and forth, frequently bouncing the ball off of the table top.

Certain modifications of table tops for playing ball-bounce games, including table tennis and the like, have been invented in order to make the game more interesting and or challenging. These inventions involve modifying the topography of the table top in order to alter the game in a manner consistent with the designer's purposes. Some modifications result in deflecting the ball in an unpredictable or awkward manner, to make the game more difficult or interesting. Another modification makes the table concave, the intent being to better contain the game, so that players standing or swimming in water can more easily return the ball. Yet another modification involves angling the two halves of the table, so that each player's court slopes down toward him or her. This arrangement facilitates the return of balls that have fallen out of play and allows the game to be played without a net.

U.S. Pat. No. 3,968,967 is an example of a ball-bounce game table top designed to deflect the ball in an unpredictable manner. The table has many hemispherical elements sized and arranged so that the players cannot predict what direction a ball striking the table top will rebound. This table top has several disadvantages. One is that the inability to predict the ball's post-bounce trajectory disrupts the continuity of the game; often players cannot even attempt to return the ball, and when they do, it is more often a case of luck than skill. Another disadvantage is that the post-bounce trajectory is independent of how the last player struck the ball, and thus the spirit of sportsmanship and competition is removed from the game; a player cannot attempt to foil his opponent by striking the ball in a more challenging or strategic direction because his efforts will not affect the post-bounce trajectory.

British patent 25,767 is an example of modifying the topography of a table tennis table top to occasionally deflect the ball in a more awkward manner. One or more adjuncts are placed on top of the game table. Each adjunct is designed to deflect the ball, and has a gradual slope upwards, in every direction, from the surface of the table. Each adjunct is of the form least calculated to obstruct a player's bat when he strikes the ball. These adjuncts, placed about the table, serve to make the game more interesting because when a ball strikes them the ball is deflected in a different direction than it would have had it merely bounced off the mostly flat table. Thus the game ends up being substantially similar to conventional table tennis, played on a flat table, but often, whether by chance or by successfully implemented strategy, the ball strikes an adjunct and is deflected in a surprising direction. These adjuncts have the disadvantage that, while making the game more challenging, they disrupt the continuity of the game; a player, lunging to return a ball, will be surprised by the ball's striking an adjunct and bouncing in a completely different direction altogether, and the player has no hope of returning the ball, and thus play is interrupted.

Soviet patent 1,556,699 is an example of a concave table tennis table top for playing table tennis in a body of water. The table floats, has a net, and is slightly concave. The concave table top alters the traditional bounce of a table tennis ball so that balls bouncing closer to the edge of the table bounce higher and with less outward velocity than they would off of a flat table. This deflection bias serves to better contain the game within the playing area, so that the players, who are swimming or standing in water, have more time to reach the ball to attempt a return. The concave table top also prevents a ball which has fallen out of play from rolling off the sides into the water. This table top has the disadvantage of slowing the game down, in that bouncing balls deflect higher and with less horizontal velocity than had they bounced off of a flat table. Thus table tennis played on a concave table is not as challenging and rewarding a game as on even a traditional flat table.

French patent 2,606,653 is an example of a table tennis like game where the two halves of the table are angled down from the center line and towards each player. The downward slope of each half of the table serves to return balls that have fallen out of play and allows for playing the game without a net. The downward sloped halves also make the game more challenging and interesting by deflecting the ball, on each bounce, with more bias towards a player's end of the table than would be achieved with a traditional flat table. One disadvantage is that the deflection bias is independent of the position of the ball's striking the table. This makes the game boring because the deflection bias is not affected by the current state of the game or a player's successfully implemented strategy. In other words, the ball always encounters the same table slope, and thus the same deflection bias, whether a player returns it hard and low, soft and high, to a comer, or to the middle of the table.

In summary, the prior art in the field of table tops for playing table tennis and the like leaves several disadvantages:

(a) unpredictability of the post-bounce trajectory disrupts the continuity of the game;

(b) unpredictability of the post-bounce trajectory removes the elements of sportsmanship, competition, and strategy from the game, as players cannot influence the post-bounce trajectory;

(c) awkward and surprising deflections disrupt the continuity of the game;

(d) modifications of table tops to provide a deflection bias make the game less challenging or slow it down. Some modifications of table tops to provide a deflection bias are boring because the deflection bias is independent of where the ball strikes the table top, and thus players have no opportunity to affect the deflection bias; and (e) traditional flat table tennis table tops do not make the game more difficult for players whose skills are closely matched and who thus end up rallying the ball back and forth at a threshold game speed, and thus flat table tennis table tops present no additional challenge to skilled players.

OBJECTS AND ADVANTAGES

Accordingly, several objects and advantages of the present invention are:

(a) to provide a table tennis table top topography which makes table tennis more challenging and interesting while improving the continuity of the game;

(b) to provide a table tennis table top topography which makes table tennis more challenging and interesting while adding elements of sportsmanship, competition, and strategy to the game;

(c) to provide a table tennis table top topography which provides a deflection bias which makes table tennis more challenging and interesting and which varies in a continuous, predictable, and smooth fashion as a function of where the ball strikes the table top; and (d) to provide a table tennis table top topography which makes table tennis more challenging and interesting by accelerating the game, at each ball return, in rough proportion to the current level of play.

A further object and advantage is to provide a table tennis table top which allows a ball which has fallen out of play to roll off the table. Still further objects and advantages will become apparent through a consideration of the following drawings and descriptions.

DRAWING FIGURES

DESCRIPTION—PREFERRED EMBODIMENT

Figure 1:
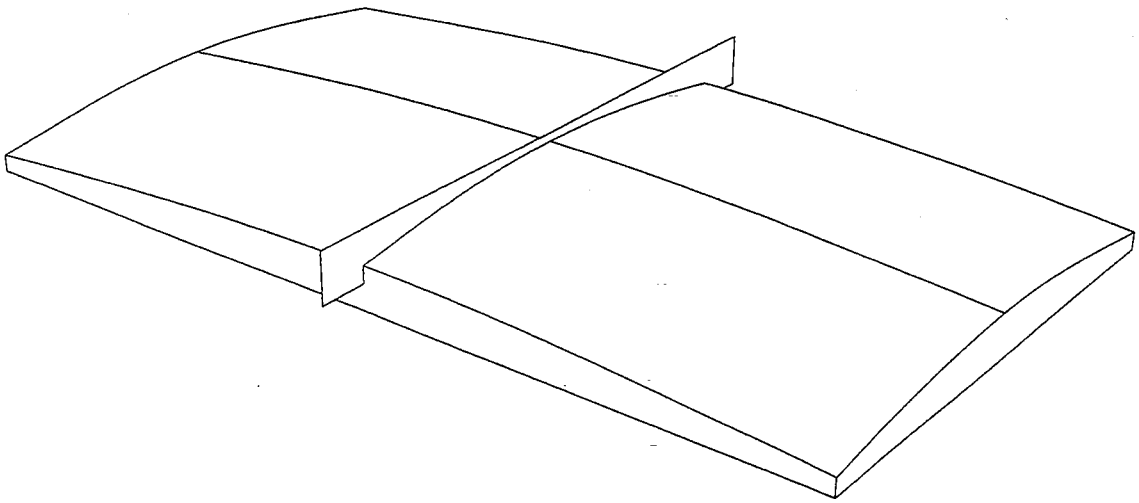
FIG. 1 shows a perspective view of a table tennis table top according to a preferred embodiment of the present invention.

The preferred embodiment of the present invention is illustrated in FIG. 1.

A rectangular table top has a substantially convex upper surface. The convexity of the table top is such that the surface is flat at the center of the table and the steepness of the surface increases towards the edges. The topography of the table is continuous and smooth; in particular there are no discontinuities in the slope of the surface. There are no inflection points in the surface, so the convexity covers the entire table top. A net is stretched across the short axis of the table, equidistant from each end. The table top has lines on it indicating different playing areas.

OPERATION—PREFERRED EMBODIMENT

The convexity of the table top provides a deflection bias wherein a ball in play bounces with more velocity towards the edges of the table, and with less vertical velocity, than had it bounced off of a flat table. The deflection bias is greater near the edges of the table, so that it serves to accelerate the game in the following manner. Most balls bouncing near the edge of the table already have a challenging trajectory, in that they have a relatively fast and low trajectory. In fact, as a general rule, the closer the bounce is to the edge, the more challenging it is to successfully return the shot, in large part because the trajectory is already low and fast. Thus, as the deflection bias is greater near the edges of the table, and as the deflection bias deflects the ball in an even more challenging trajectory, the game accelerates roughly in proportion to the current level of play. In other words, the more challenging the game is at any one instant, the more challenging the game becomes in the next.

SUMMARY, RAMIFICATIONS, AND SCOPE

Accordingly, the reader will see that the game accelerating table tennis table top of this invention provides for a table tennis table top which makes the game more challenging and interesting. This is accomplished while improving the continuity of the game. The topography of the table top actually increases the challenge of the game as a function of the current level of play. Thus the game accelerates, so that even highly skilled and closely matched opponents can have fun and amuse themselves and spectators. Since the topography of the table is clearly defined and smooth, without any inflection points, and without discontinuities in slope, the game is made more challenging without resorting to awkward and unpredictable deflections. Since the deflection bias is an easily understood function of where the ball hits the table, a player can attempt to use the deflection bias in a strategic manner, to defeat her opponent. Furthermore, since her opponent can easily predict the post-bounce trajectory, the strategy, while resulting in a more challenging shot, is always exposed, allowing the players to establish a sporting rapport. These added elements of sportsmanship, competition, and strategy cannot be achieved by any of the table tennis table tops in the prior art.

Figure 2:
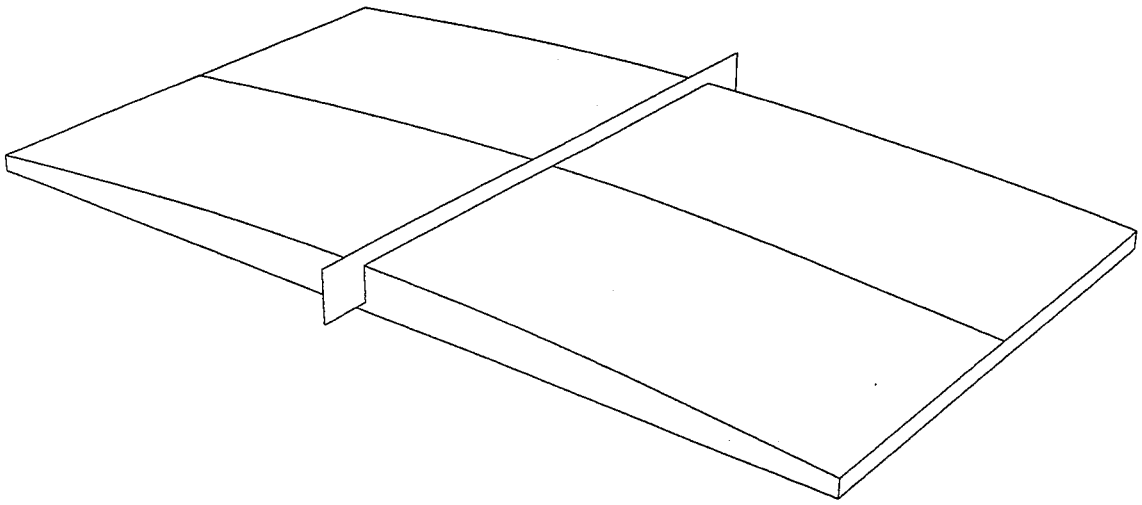
FIG. 2 shows a perspective view of an embodiment of the present invention in which the convexity is limited to the long axis of the table.
Figure 3:
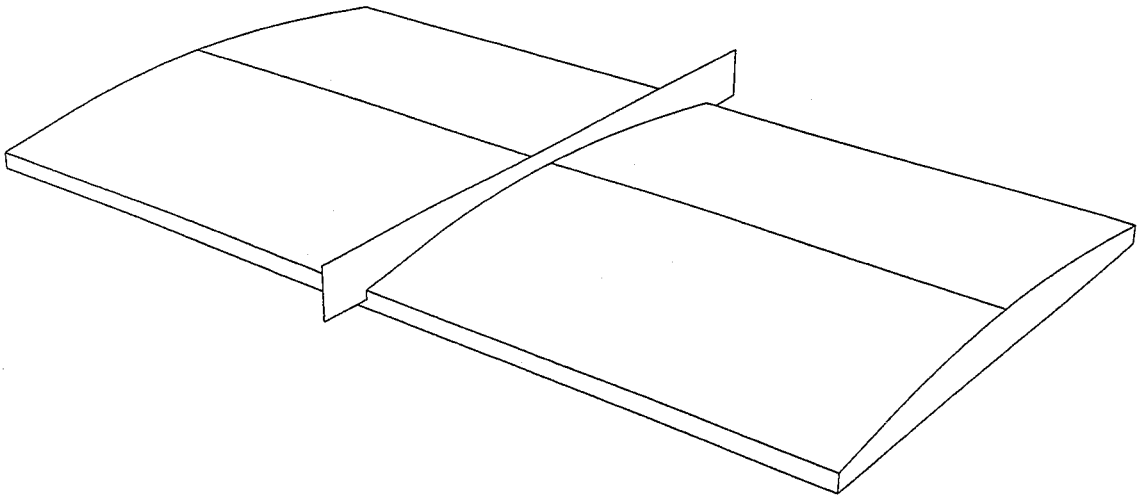
FIG. 3 shows a perspective view of an embodiment of the present invention in which the convexity is limited to the short axis of the table.

Although the above descriptions contain many specificities, these should not be construed as limitations on the scope of the invention, but rather as exemplifications of the preferred embodiments thereof. Many variations are possible. A small slot may be made in the table to better accommodate the net, or the base of the net may be curved to fit over the table. The height of the net can be varied, or the game could be played without a net. The table could be constructed so as to allow folding or disassembling into a more compact and easily storable form; when deployed into a game ready state the gaps and hinges or other necessary contrivances would be small enough or positioned so as to not substantially affect the deflection bias. The playing surface could be textured with surface variations, so that spin effects can be better realized during the bounce of the ball thanks to the improved traction, while the scale of the variations remain small enough, relative to the size of the balls, that spinless balls experience the same deflection bias as from a smooth surface. The convexity could be limited to one direction, as in FIGS. 2 and 3. The convexity need not be radial in nature. For example, in FIG. 1, the topography is defined by the sum of two cosine functions, one for each axis of the table and each having a different periodicity. Alternatively, the surface height could be defined by the sum of two inverted parabolas, one for each axis of the table. The table need not be rectangular. One possibility is a round table with a radial convexity; this would simply be a slice of a sphere, with the curved surface serving as the playing surface. Accordingly, the scope of the invention should be determined not by the embodiments illustrated, but by the appended claims and their legal equivalents.

I claim:

1. An elongated ball bounce game table top comprising:

a playing surface cable of deflecting a ball in a multitude of directions, said playing surface having a convex configuration such that its center lies in a plane higher than its perimeter when said table top is substantially horizontal;

said playing surface being free of inflection points and free of discontinuities in slope, whereby the convexity is smooth and continuous over the entire playing surface.

2. The game table as defined in claim 1, wherein said table is a table tennis table, said table having a net extending transversely across said playing surface, said net being attached to said table and upper and lower edges, said upper edge being substantially straight and said lower edge having a curvature that substantially conform to the convex curvature of said playing surface.

* * * * *